US005479872A

United States Patent [19]

Hulett

[11] Patent Number: 5,479,872

[45] Date of Patent: Jan. 2, 1996

[54] SUPPORT FOR BOATCOVER

[76] Inventor: Randall V. Hulett, N 13584 McCune Rd., Fairchild, Wis. 54741

[21] Appl. No.: 378,864

[22] Filed: Jan. 23, 1995

Related U.S. Application Data

[63] Continuation of Ser. No. 199,003, Feb. 18, 1994, abandoned.

[51] Int. Cl.[6] ..... B63B 17/00

[52] U.S. Cl. ..... 114/361

[58] Field of Search ..... 114/361, 362, 114/343; 135/87, 88, 114

[56] References Cited

U.S. PATENT DOCUMENTS

| | | | |
|---|---|---|---|
| 2,829,660 | 4/1958 | Wester et al. | 114/361 |
| 3,106,931 | 10/1963 | Cooper | 114/361 |
| 3,203,438 | 8/1965 | Watts et al. | 114/361 |
| 3,799,099 | 3/1974 | Conover . | |
| 4,019,212 | 4/1977 | Downer . | |
| 4,075,723 | 2/1978 | Bareis et al. . | |
| 4,927,109 | 5/1990 | Wilson . | |
| 4,979,457 | 12/1990 | Sommerhauser et al. | 114/361 |
| 5,076,195 | 12/1991 | Heyne . | |

*Primary Examiner*—Stephen Avila

[57] ABSTRACT

A new and improved support apparatus is provided for a flexible sheet boat cover which includes a first resilient support assembly, a telescopic extensible and retractable pole assembly connected to the first resilient support assembly, and a second resilient support assembly connected to the pole assembly. The first resilient support assembly is adapted to be supported by a portion of a boat body when the pole assembly is in an extended condition. The second resilient support assembly is adapted to be supported by a top portion of a boat windshield when the pole assembly is in an extended condition. The pole assembly is adapted to support a flexible sheet boat cover when the pole assembly is in an extended condition and supported by the first resilient support assembly and the second resilient support assembly. The first resilient support assembly and the second resilient support assembly include resilient pads. The first resilient support assembly may include a pair of resilient pad assemblies adapted to fit onto tops of converging boat railings. A crossbar assembly is connected to the resilient pad assemblies, and a connector assembly is provided for connecting the crossbar assembly to the pole assembly.

3 Claims, 5 Drawing Sheets

SUPPORT FOR BOATCOVER

This application is a continuation of application Ser. No. 08/199,003, filed Feb. 18, 1994, now abandoned.

BACKGROUND OF THE INVENTION

1. Field of the Invention

The present invention relates generally to boats and, more particularly, to supports for boat covers comprised of flexible sheets.

2. Description of the Prior Art

Many boats do not have roofs, and as a result, the passenger compartments are open to the elements of rain, snow, and wind. When such open boats are not in use, they are often covered with flexible covers, often called tarpaulins or tarps. A problem associated with tarps is that water or snow often forms pools on the tarps. The pools of water on the tarps can put excessive pressure on the tarp and cause it to tear. The excessive weight may cause the tarp to be pulled from its supports and cause the tarp to collapse causing the pooled water or snow to enter the boat. In addition, after a rain or snow storm, and the boat user is planning to use the boat, the user may be required to remove large quantities of pooled water or snow before being able to remove the tarp and gain access to the boat. For these and other reasons, it would be desirable if a boat tarp could be supported in such as way as to prevent the pooling of water or snow on the tarp.

In an effort to prevent water or snow from pooling on a tarp some people employ certain makeshift steps. For example, some people place the tarp over the boat and then climb under the tarp to place a vertically standing stick under the tarp. The vertically standing stick supports a portion of the tarp at an elevated position so that the tarp slopes downward from the elevated position. Water or snow readily slides down the sloping tarp and does not form undesirable pools. A disadvantage of this method of tarp support is the necessity of climbing under the tarp. In this respect, it would be desirable if a device were provided for supporting a portion of a tarp in an elevated position without requiring a person to get under the tarp to install the tarp support.

Throughout the years, a number of innovations have been developed relating to supports for boat tarps, and the following U.S. patents are representative of some of those innovations: U.S. Pat. No. 4,019,212; 4,075,723; 4,927,109; and 5,076,195. More specifically, U.S. Pat. No. 4,019,212 discloses a complex boat cover apparatus that includes a mechanism for lifting a boat out of the water and includes a complex subframe device and an assembly for suspending a portion of a tarp at an elevated position above a boat for supporting. A salient disadvantage is associated with this complex apparatus. To utilize this tarp support, a boat must always come to the location of the support. If a boat is docked at another location, the tarp support will not be available. In this respect, it would be desirable if a device were provided for supporting a portion of a tarp wherein the tarp support device were present on the boat so that the tarp support device were present with the boat wherever the boat was docked.

U.S. Pat. No. 4,075,723 discloses a flexible, resilient rib that is extended from one side of a boat to another side of the boat. The rib is extended as an arch supported by the sides of the boat. The peak of the arch supports the tarp in an elevated position. One disadvantage of this flexible rib device is that it is quite long when not in use. As a result, a suitable storage location must be found for the relatively long flexible rib when not in use. In this respect, it would be desirable if a device were provided for supporting a portion of a tarp in an elevated position that does not take up a lot of space when the tarp supporting device is not in use. A second disadvantage associated with this device relates to the fact that it extends from side to side on the boat. A boat is generally longer than it is wide. Therefore, one side to side would have to be exceedingly long to have a sufficiently high arch to allow the tarp to drape properly. To avoid this problem of excessive height of a side to side tarp support, it would be desirable of a tarp support device supported a portion of a tarp from front to back on the boat.

U.S. Pat. No. 4,927,109 discloses a support for a boat tarp which includes a retractable vertical column that has one end on the floor of the boat and has another end on the bottomside of the tarp. One disadvantage of this device is the relatively large amount of pressure that may be exerted on the boat floor. The compete integrity of the boat floor is most important to avoid leaks and sinking. Exertion of unnecessary pressure on the boat floor may compromise such floor integrity. In this respect, it would be desirable if a device were provided for supporting a portion of a tarp which did not exert pressure on the floor of the boat. Another disadvantage of this device relates to the fact that the tarp is supported by a single support area located above the column. The single support area has a relatively small surface area. As a result, the weight of the tarp is concentrated on a small surface causing a relatively high stress to be exerted on the tarp. In this respect, it would be desirable if a device were provided for supporting a portion of a tarp which had a relatively large surface area to reduce stress on the tarp.

U.S. Pat. No. 5,076,195 discloses a boat tarp cover that covers the front portion of a boat. Often, the areas of a boat that need most protection from water and snow are rear portions of a boat. In this respect, it would be desirable if a tarp supporting device were provided which supports a tarp over both the front and rear portions of a boat.

U.S. Pat. No. 3,799,099 may be of interest for its disclosure of a telescoping boat hook and pole.

Still other features would be desirable in a support apparatus for a flexible sheet boat cover. For example, in many boats, the most elevated point in the boat is present at the top of the windshield. In this respect, it would be desirable if the top of the windshield could be utilized in a tarp support apparatus.

When a tarp support is supporting a tarp, the weight of the tarp and the tarp support is born by the boat. In order not to damage portions of the boat that support the tarp support and tarp, it would be desirable if resilient pads could be provided between the tarp support and the boat.

In the front portions of some boats, there are railings that are present that converge toward the bow of the boat. Under certain circumstances, it may be desirable is a tarp support could be supported by those converging railings.

Thus, while the foregoing body of prior art indicates it to be well known to use tarp support devices, the prior art described above does not teach or suggest a support apparatus for a flexible sheet boat cover (tarp) which has the following combination of desirable features: (1) can support a boat tarp in such as way as to prevent the pooling of water or snow on the tarp; (2) supports a portion of a tarp in an elevated position without requiring a person to get under the tarp to install a tarp support; (3) provides a tarp support device that is present on the boat at all times so that the tarp support device is present with the boat wherever the boat is docked; (4) does not take up a lot of space when the tarp supporting device is not in use; (5) support a portion of a tarp from front to back on the boat; (6) does not exert pressure on the floor of the boat; (7) has a relatively large surface area to reduce stress on the tarp; (8) supports a tarp over both the front and rear portions of a boat; (9) utilizes the top of a boat windshield for supporting a tarp support device; (10) provides resilient pads between the tarp support and the boat; and (11) permits a tarp support to be supported by railings which converge at the bow of the boat. The foregoing desired characteristics are provided by the unique support apparatus for a flexible sheet boat cover of the present invention as will be made apparent from the following description thereof. Other advantages of the present invention over the prior art also will be rendered evident.

SUMMARY OF THE INVENTION

To achieve the foregoing and other advantages, the present invention, briefly described, provides a new and improved support apparatus for a flexible sheet boat cover which includes a first resilient support assembly, a telescopic extensible and retractable pole assembly connected to the first resilient support assembly, and a second resilient support assembly connected to the pole assembly. The first resilient support assembly is adapted to be supported by a portion of a boat body when the pole assembly is in an extended condition. The second resilient support assembly is adapted to be supported by a top portion of a boat windshield when the pole assembly is in an extended condition. The pole assembly is adapted to support a flexible sheet boat cover when the pole assembly is in an extended condition and supported by the first resilient support assembly and the second resilient support assembly. The first resilient support assembly and the second resilient support assembly include resilient pads.

The first resilient support assembly may include a pair of resilient pad assemblies adapted to fit onto tops of converging boat railings. A crossbar assembly is connected to the resilient pad assemblies, and a connector assembly is provided for connecting the crossbar assembly to the pole assembly.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining at least two preferred embodiment of the invention in detail, it is understood that the invention is not limited in its application to the details of the construction and to the arrangements of the components set forth in the following description or illustrated in the drawings. The invention is capable of other embodiments and of being practiced .and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

Further, the purpose of the foregoing Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

It is therefore an object of the present invention to provide a new and improved support apparatus for a flexible sheet boat cover which has all of the advantages of the prior art and none of the disadvantages.

It is another object of the present invention to provide a new and improved support apparatus for a flexible sheet boat cover which may be easily and efficiently manufactured and marketed.

It is a further object of the present invention to provide a new and improved support apparatus for a flexible sheet boat cover which is of durable and reliable construction.

An even further object of the present invention is to provide a new and improved support apparatus for a flexible sheet boat cover which is susceptible of a low cost of manufacture with regard to both materials and labor, and which accordingly is then susceptible of low prices of sale to the consuming public, thereby making such support apparatus for a flexible sheet boat cover available to the buying public.

Still yet a further object of the present invention is to provide a new and improved support apparatus for a flexible sheet boat cover which can support a boat tarp in such as way as to prevent the pooling of water or snow on the tarp.

Still another object of the present invention is to provide a new and improved support apparatus for a flexible sheet boat cover that supports a portion of a tarp in an elevated position without requiting a person to get under the tarp to install a tarp support.

Yet another object of the present invention is to provide a new and improved support apparatus for a flexible sheet boat cover which provides a tarp support device that is present on the boat at all times so that the tarp support device is present with the boat wherever the boat is docked.

Even another object of the present invention is to provide a new and improved support apparatus for a flexible sheet boat cover that does not take up a lot of space when the tarp supporting device is not in use.

Still a further object of the present invention is to provide a new and improved support apparatus for a flexible sheet boat cover which support a portion of a tarp from front to back on the boat.

Yet another object of the present invention is to provide a new and improved support apparatus for a flexible sheet boat cover that does not exert pressure on the floor of the boat.

Still another object of the present invention is to provide a new and improved support apparatus for a flexible sheet boat cover which has a relatively large surface area to reduce stress on the tarp.

Yet another object of the present invention is to provide a new and improved support apparatus for a flexable sheet boat cover that supports a tarp over both the front and rear portions of a boat.

Still a further object of the present invention is to provide a new and improved support apparatus for a flexible sheet boat cover that utilizes the top of a boat windshield for supporting a tarp support device.

Yet another object of the present invention is to provide a new and improved support apparatus for a flexible sheet boat cover which provides resilient pads between the tarp support and the boat.

Still a further object of the present invention is to provide a new and improved support apparatus for a flexible sheet boat cover that permits a tarp support to be supported by railings which converge at the bow of the boat.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein.

DESCRIPTION OF THE PREFERRED EMBODIMENT

Figure 1:
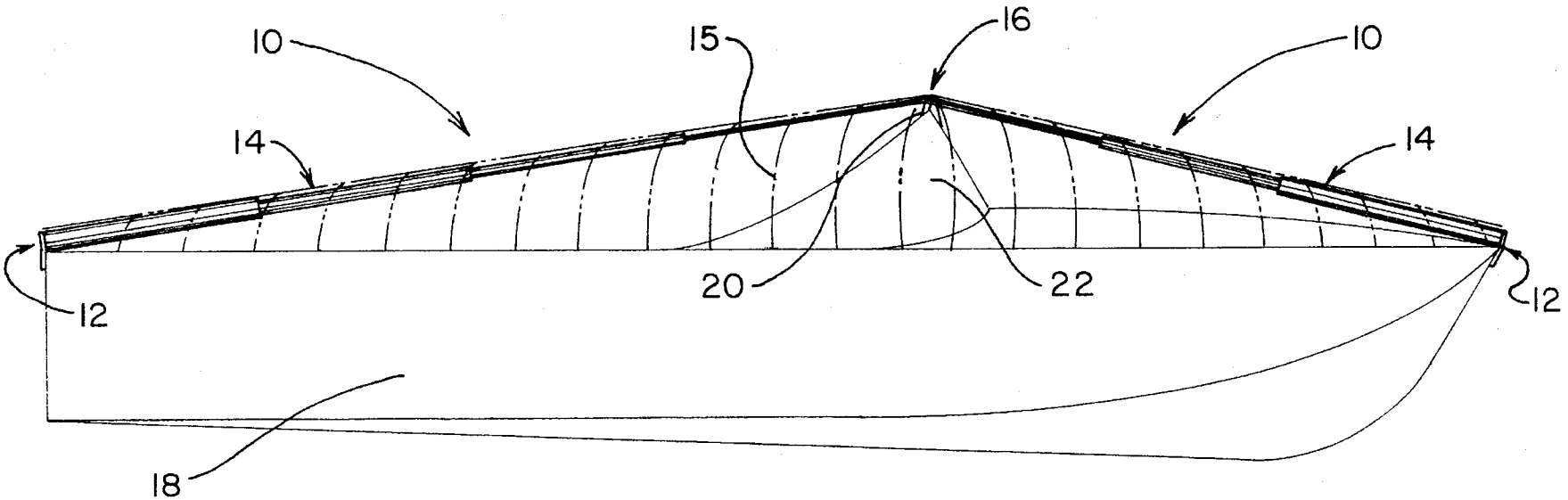
FIG. 1 is a side view showing two specimens of a first preferred embodiment of the support apparatus for a flexible sheet boat cover of the invention installed on a boat having a windshield.
Figure 2:
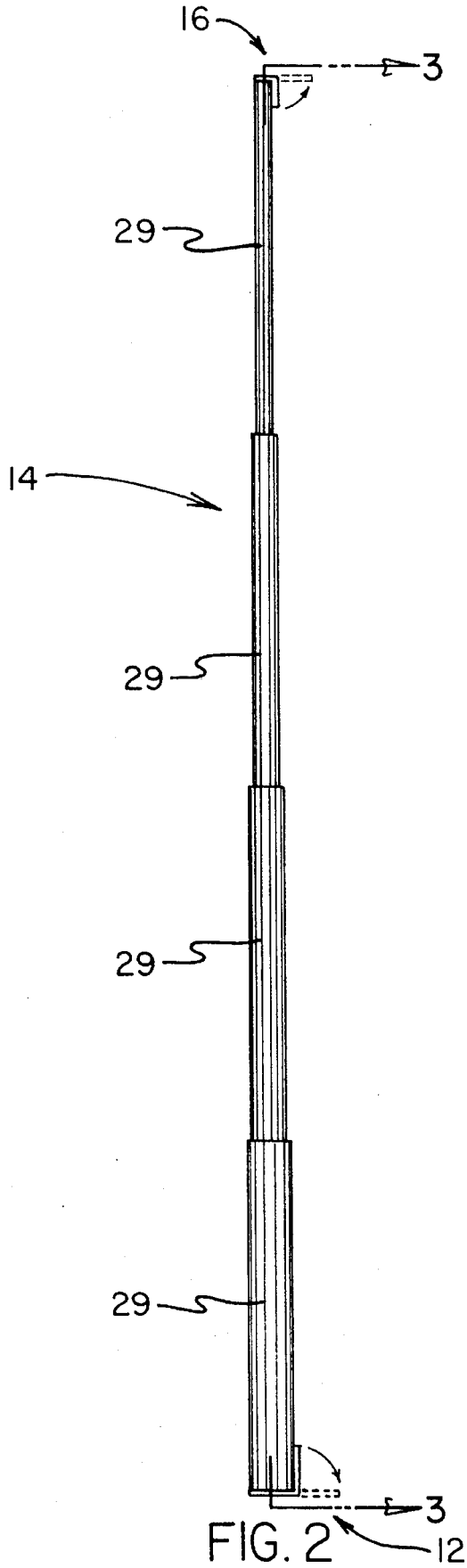
FIG. 2 is an enlarged side view of one of the specimens of the first embodiment of the invention shown in FIG. 1 shown in an extended condition and removed from a boat.

With reference to the drawings, a new and improved support apparatus for a flexible sheet boat cover embodying the principles and concepts of the present invention will be described.

Turning to FIGS. 1–6, there is shown a first exemplary embodiment of the support apparatus for a flexible sheet boat cover of the invention generally designated by reference numeral 10. In its preferred form, support apparatus a flexible sheet boat cover 10 includes a first resilient support assembly 12, a telescopic extensible and retractable pole assembly 14 connected to the first resilient support assembly 12, and a second resilient support assembly 16 connected to the pole assembly 14. The first resilient support assembly 12 is adapted to be supported by a portion of a boat body 18 when the pole assembly 14 is in an extended condition. The second resilient support assembly 16 is adapted to be supported by a top portion 20 of a boat windshield 22 when the pole assembly 14 is in an extended condition. The pole assembly 14 is adapted to support a flexible sheet boat cover 15 when the pole assembly 14 is in an extended condition and supported by the first resilient support assembly 12 and the second resilient support assembly 16. A flexible sheet boat cover 15 is often called a tarpaulin or tarp. The first resilient support assembly 12 and the second resilient support assembly 16 may be resilient rubber pads that may be sold in kit form with a pole assembly 14. The extensible nature of the pole assembly 14 permits the support apparatus for a flexible sheet boat cover of the invention to be usable for a wide range of boat sizes. To use the pole assembly 14, the pole assembly 14 may be partially or fully extended.

When the boat is to be stored, one of the support apparatuses 10 of the invention is installed between the boat windshield 22 and the rear of the boat. Another of the support apparatuses 10 of the invention is installed between the boat windshield 22 and the front of the boat. Preferably, each of the support apparatuses of the invention is installed along a longitudinal axis of the boat. The support apparatuses 10 of the invention are sufficiently strong in the extended condition to support a boat tarp and to support the boat tarp after is has been stretched taut over the support apparatuses. Preferably, the pole assembly 14 is made from rust resistant, telescopic metal tubes 29.

Figure 3:
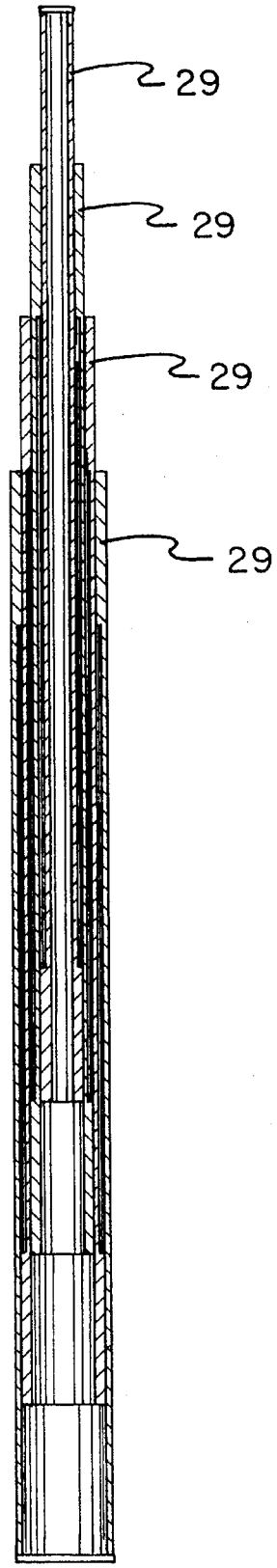
FIG. 3 is an enlarged cross-sectional view, taken along line 3—3 in FIG. 2, of the embodiment of the invention shown in FIG. 2 in a retracted condition.
Figure 4:
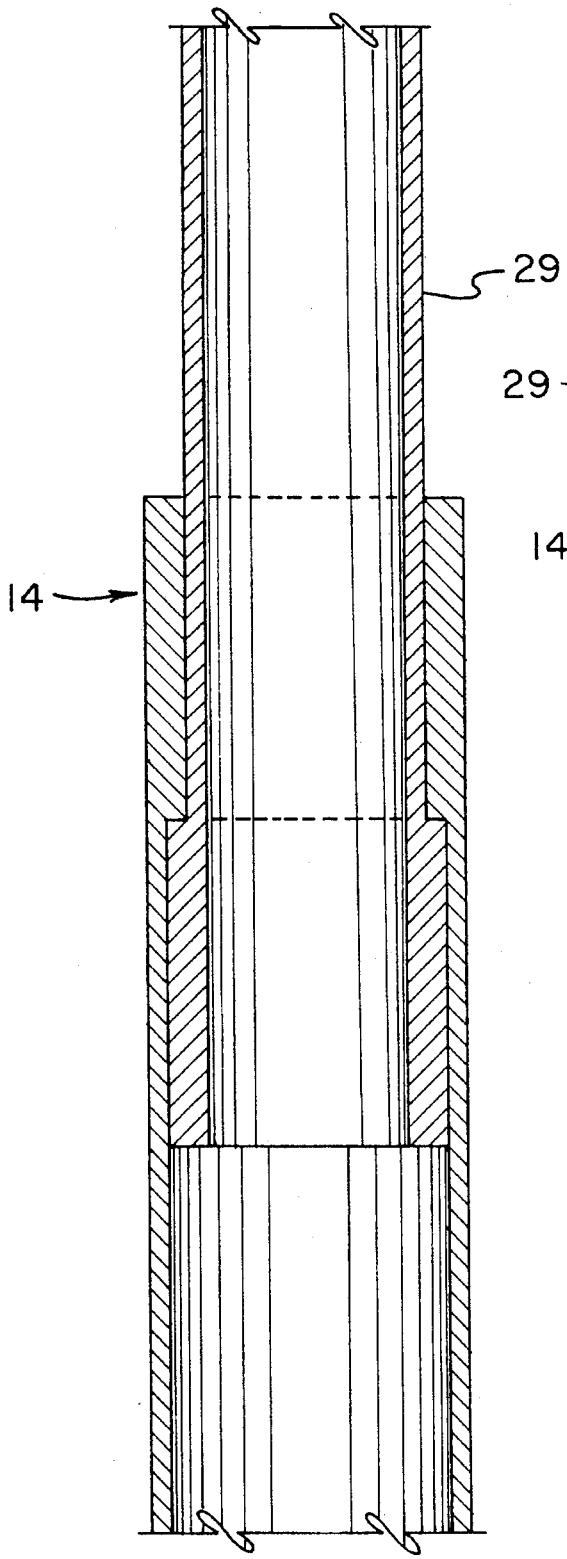
FIG. 4 is an enlarged cross-sectional view of two telescopic members of the embodiment of the invention shown in FIG. 2 wherein the telescopic members are shown in an extended condition.
Figure 5:
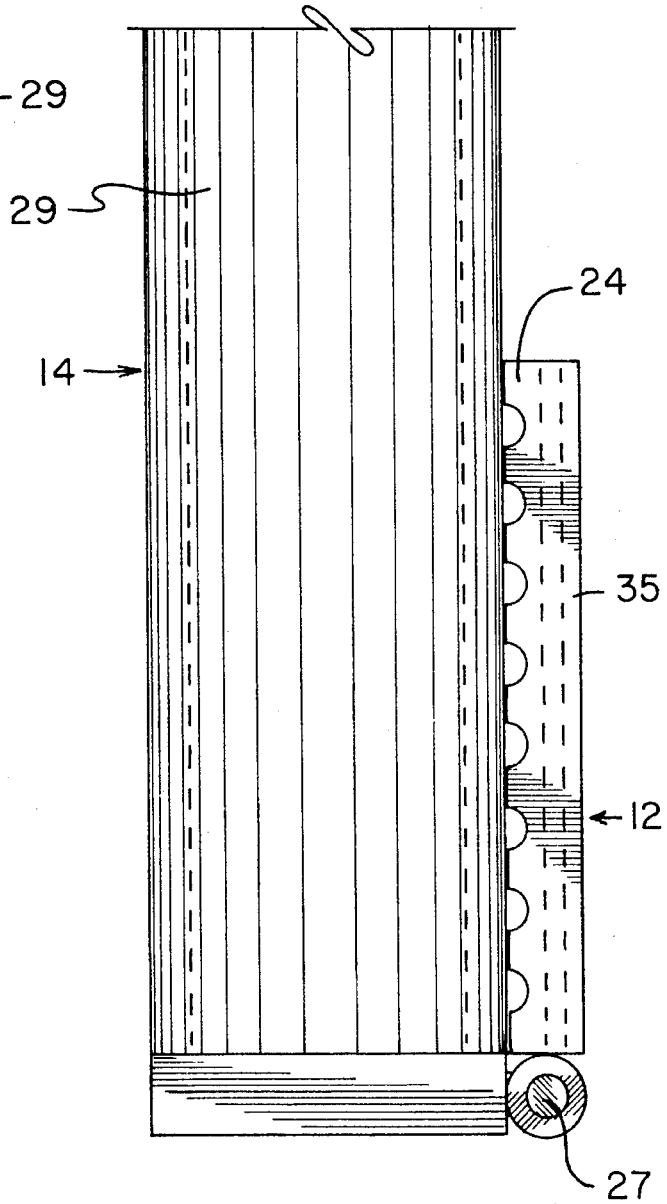
FIG. 5 is an enlarged side view of a first end of the embodiment of the invention shown in FIG. 2 removed from a boat.
Figure 6:
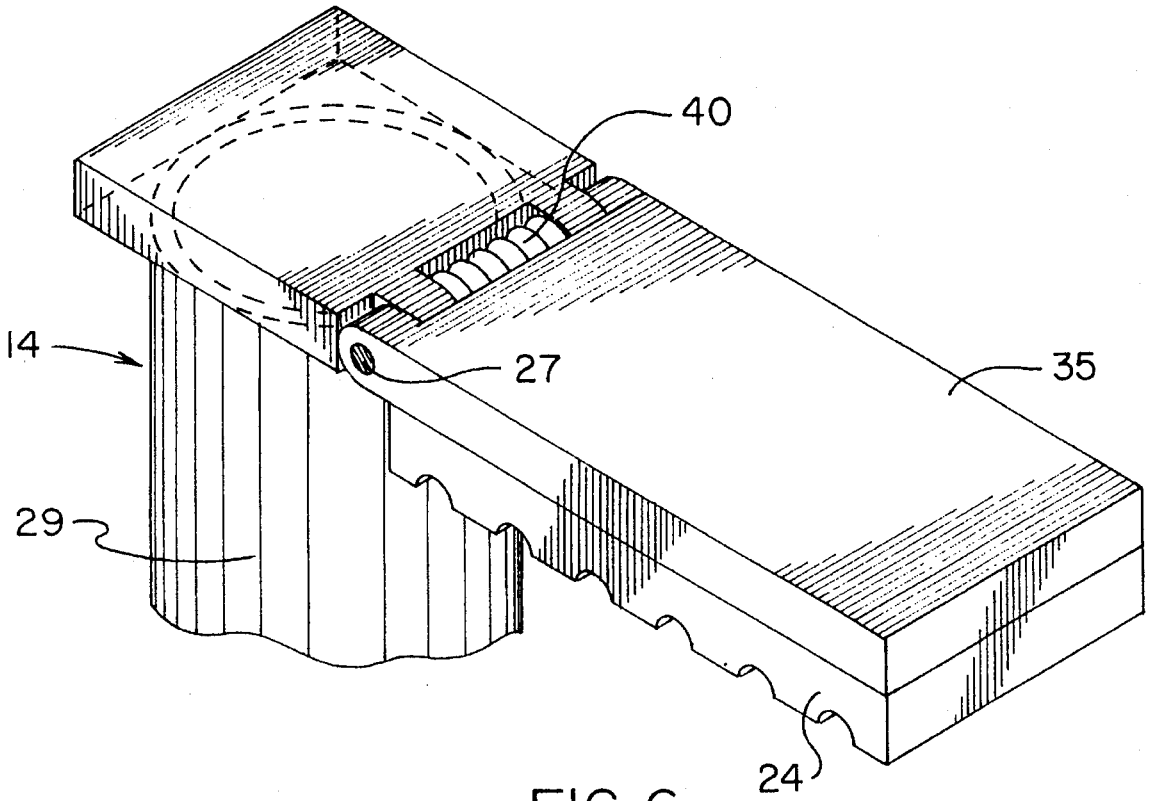
FIG. 6 is an enlarged perspective view of a second end of the embodiment of the invention shown in FIG. 2 removed from a boat.

When the boat is to be used, the tarp is removed, and the support apparatuses of the invention can be taken down. The pole assembly 14 can be retracted to form a compact structure as shown in FIG. 3 which takes up a relatively small amount of space in storage. If desired, the pole assembly 14 can be secured to the boat by a swivel assembly so that when the pole assembly 14 is retracted, the retracted pole assembly 14 can be swung into a storage mode.

The first resilient support assembly 12 and the second resilient support assembly 16 include resilient pads 24. The resilient pads 24 may be positioned on holders which are connected to the pole assembly 14 by fixed connections. Alternately, the resilient pads 24 are hingedly connected to the pole assembly 14. As shown in FIG. 1, the resilient pads 24 are pressed up against side surfaces of the boat. As shown in greater detail in FIGS. 5 and 6, the resilient pads 24 are positioned on rigid backplates 35 and are connected by hinges 27 to the pole assembly 14. A spring 40 can be biased between a rigid backplate 35 and a pole assembly 14. When the pole assembly 14 is not placed on the boat, the springs 40 urge the rigid backplates 35 to move around the hinges 27 and become parallel to the pole assembly 14. On the other hand, when the resilient pads 24 are pressed up against side surfaces of the boat, the springs 40 urge the resilient pads 24 against the side surfaces of the boats.

Figure 7:
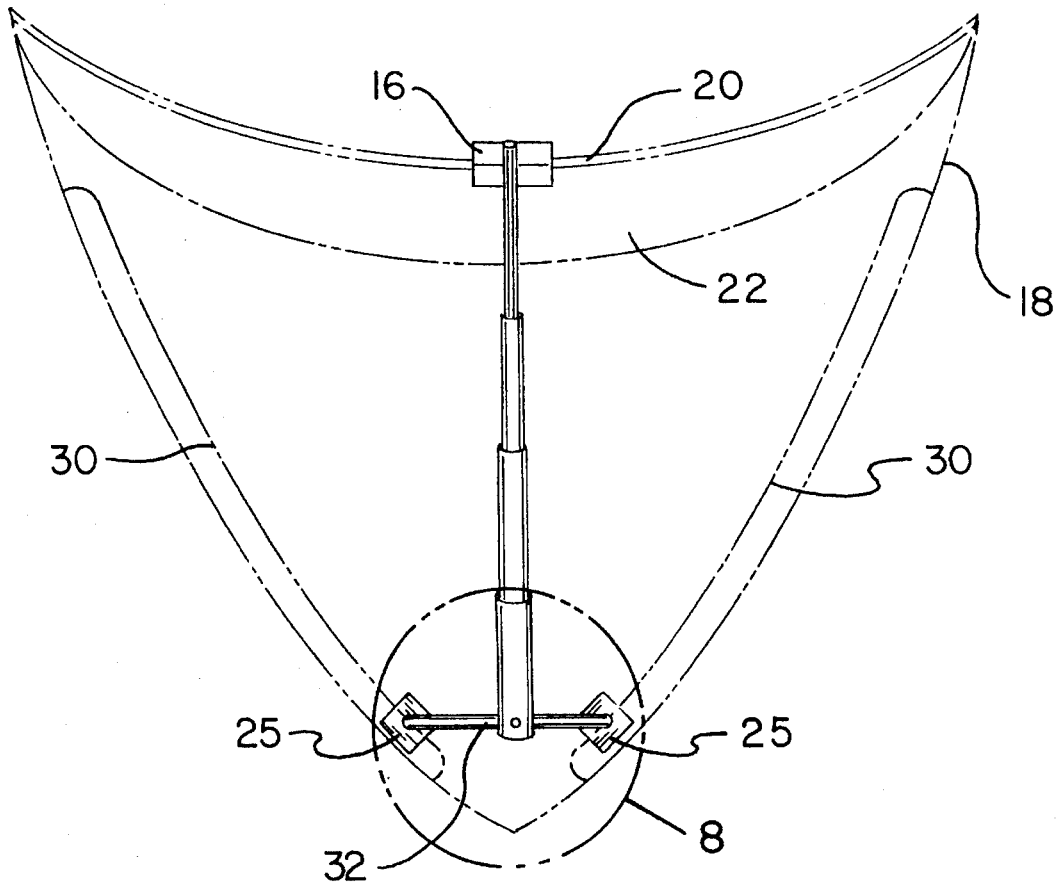
FIG. 7 is a top view of a second embodiment of the support apparatus for a flexible sheet boat cover of the invention installed on a front portion of a boat and utilizing two convergent railings for supporting the embodiment of the invention.
Figure 8:
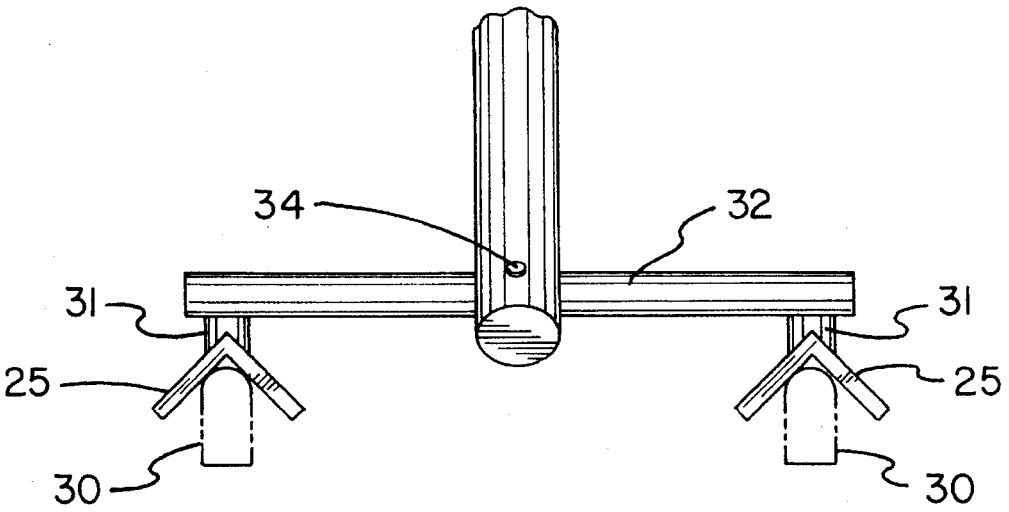
FIG. 8 is an enlarged front view of the portion of the embodiment of the invention shown in FIG. 7 and contained in the circled region 8 of FIG. 7.

Turning to FIGS. 7–8, a second embodiment of the invention is shown. Reference numerals are shown that correspond to like reference numerals that designate like elements shown in the other figures. In addition, the first resilient support assembly. 12 includes a pair of resilient pad assemblies 25 adapted to fit onto tops of converging boat railings 30. A crossbar assembly 32 is connected to the resilient pad assemblies 25, and a connector assembly 34 is provided for connecting the crossbar assembly 32 to the pole assembly 14. The resilient pad assemblies 25 are positioned on rigid holders 31 which are connected to the pole assembly 14 by fixed connections.

The components of the support apparatus for a flexible sheet boat cover of the invention can be made from inexpensive and durable metal and plastic materials.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a new and improved support apparatus for a flexible sheet boat cover that is low in cost, relatively simple in design and operation, and which may advantageously be used to support a boat tarp in such as way as to prevent the pooling of water or snow on the tarp. With the invention, a support apparatus for a flexible sheet boat cover is provided which supports a portion of a tarp in an elevated position without requiring a person to get under the tarp to install a tarp support. With the invention, a support apparatus for a flexible sheet boat cover is provided which provides a tarp support device that is present on the boat at all times so that the tarp support device is present with the boat wherever the boat is docked. With the invention, a support apparatus for a flexible sheet boat cover is provided which does not take up a lot of space when the tarp supporting device is not in use. With the invention, a support apparatus for a flexible sheet boat cover is provided which support a portion of a tarp from front to back on the boat. With the invention, a support apparatus for a flexible sheet boat cover is provided which does not exert pressure on the floor of the boat. With the invention, a support apparatus for a flexible sheet boat cover is provided which has a relatively large surface area to reduce stress on the tarp. With the invention, a support apparatus for a flexible sheet boat cover is provided which supports a tarp over both the front and rear portions of a boat. With the invention, a support apparatus for a flexible sheet boat cover is provided which utilizes the top of a boat windshield for supporting a tarp support device. With the invention, a support apparatus for a flexible sheet boat cover is provided which provides resilient pads between the tarp support and the boat. With the invention, a support apparatus for a flexible sheet boat cover is provided which permits a tarp support to be supported by railings which converge at the bow of the boat.

With respect to the above description, it should be realized that the optimum dimensional relationships for the parts of the invention, to include variations in size, form function and manner of operation, assembly and use, are deemed readily apparent and obvious to those skilled in the art, and therefore, all relationships equivalent to those illustrated in the drawings and described in the specification are intended to be encompassed only by the scope of appended claims.

While the present invention has been shown in the drawings and fully described above with particularity and detail in connection with what is presently deemed to be the most practical and preferred embodiments of the invention, it will be apparent to those of ordinary skill in the art that many modifications thereof may be made without departing from the principles and concepts set forth herein. Hence, the proper scope of the present invention should be determined only by the broadest interpretation of the appended claims so as to encompass all such modifications and equivalents.

What is claimed as being new and desired to be protected by Letters Patent of the United States is as follows:

1. A new and improved support apparatus for a flexible sheet boat cover for a boat, comprising:

a first resilient support assembly, a telescopic extensible and retractable pole assembly connected at a first end to said first resilient support assembly, and a second resilient support assembly connected to a second end of said pole assembly, wherein said first resilient support assembly is adapted to be supported by a portion of a boat body and includes a resilient portion which presses up against a side surface of the boat toward said second end of said telescopic extensible and retractable pole assembly when said pole assembly is in an extended condition, wherein said second resilient support assembly is adapted to be supported by a top portion of a boat windshield when said pole assembly is in an extended condition and a portion of said second resilient support assembly presses up against the top portion of the boat windshield toward said first end of said telescopic extensible and retractable pole assembly, wherein said pole assembly is adapted to support a flexible sheet boat cover when said pole assembly is in an extended condition and supported by said first resilient support assembly and said second resilient support assembly, and wherein at least said first or said second resilient support assembly comprises a plate member having opposed ends, a hinge connected between one of said opposed ends and a corresponding telescopic extensible and retractable pole assembly, said hinge adapted to permit said plate member to assume a first folded position proximal to said corresponding telescopic extensible and retractable pole assembly and a second unfolded position distal with respect to said corresponding telescopic extensible and retractable pole assembly, and resilient means for normally biasing said plate member into said first folded position.

2. The apparatus described in claim 1 wherein said first resilient support assembly and said second resilient support assembly include resilient pads.

3. A new and improved support apparatus for a flexible sheet boat cover for a boat, comprising:

a first resilient support assembly, a telescopic extensible and retractable pole assembly connected to said first resilient support assembly, and a second resilient support assembly connected to said pole assembly, wherein said first resilient support assembly is adapted to be supported by a portion of a boat body and includes a portion which presses up against a side surface of the boat when said pole assembly is in an extended condition, wherein said second resilient support assembly is adapted to be supported by a top portion of a boat windshield when said pole assembly is in an extended condition, and wherein said pole assembly is adapted to support a flexible sheet boat cover when said pole assembly is in an extended condition and supported by said first resilient support assembly and said second resilient support assembly, wherein said first resilient support assembly includes:

a pair of resilient pad assemblies adapted to fit onto tops of converging boat railings, a crossbar assembly connected to said resilient pad assemblies, and a connector assembly for connecting said crossbar assembly to said pole assembly.

* * * * *